US006409489B1

(12) United States Patent
Bodart et al.

(10) Patent No.: US 6,409,489 B1
(45) Date of Patent: Jun. 25, 2002

(54) COMPRESSOR INSTALLATION WITH WATER-INJECTED COMPRESSOR ELEMENT

(75) Inventors: Willy Joseph Rosa Bodart, Antwerp; Bart Anton Lode Talboom, Kontich, both of (BE)

(73) Assignee: Atlas Copco Airpower, naamloze vennootschap, Wilrijk (BE)

( * ) Notice: Subject to any disclaimer, the term of this patent is extended or adjusted under 35 U.S.C. 154(b) by 0 days.

(21) Appl. No.: 09/891,297

(22) Filed: Jun. 27, 2001

(30) Foreign Application Priority Data

Jun. 27, 2000 (BE) ..... 000409

(51) Int. Cl.[7] ..... F04C 29/02

(52) U.S. Cl. ..... 418/84; 418/85; 418/87; 418/89; 418/97; 418/DIG. 1

(58) Field of Search ..... 418/84, 87, 89, 418/97, 85, DIG. 1; 417/336

(56) References Cited

U.S. PATENT DOCUMENTS 4,968,231 A * 11/1990 Zimmern et al. ..... 418/85
5,033,944 A * 7/1991 Lassota ..... 418/85
5,174,741 A * 12/1992 Tohgo ..... 418/84
6,016,657 A * 1/2000 Buschur ..... 60/424
6,102,683 A * 8/2000 Kirsten ..... 418/85
6,174,148 B1 * 1/2001 Suzuki ..... 418/87

FOREIGN PATENT DOCUMENTS

DE 44 47 097 7/1996
DE 197 29 498 2/1999
JP 58-148287 * 9/1983 ..... 417/336

* cited by examiner

*Primary Examiner*—Thomas Denion
*Assistant Examiner*—Theresa Trieu
(74) *Attorney, Agent, or Firm*—Bacon & Thomas, PLLC

(57) ABSTRACT

The invention concerns a compressor installation with a water-injected compressor element (1) having a water cycle (6) and a water supply device (15) for supplying water to the water cycle (6), containing a water supply line (16) with a controllable valve (18) and a reverse osmosis filter (17) therein. Onto the water cycle is connected a by-pass (21) in which are erected an ion exchanger (22) and a controllable valve (23). A valve (18) in the water supply line (16) is controlled by a device (20) for measuring the amount of water in the water cycle (6), and the valve (23) in the by-pass (21) is controlled by a device (24) for measuring the conductivity of the water.

9 Claims, 1 Drawing Sheet

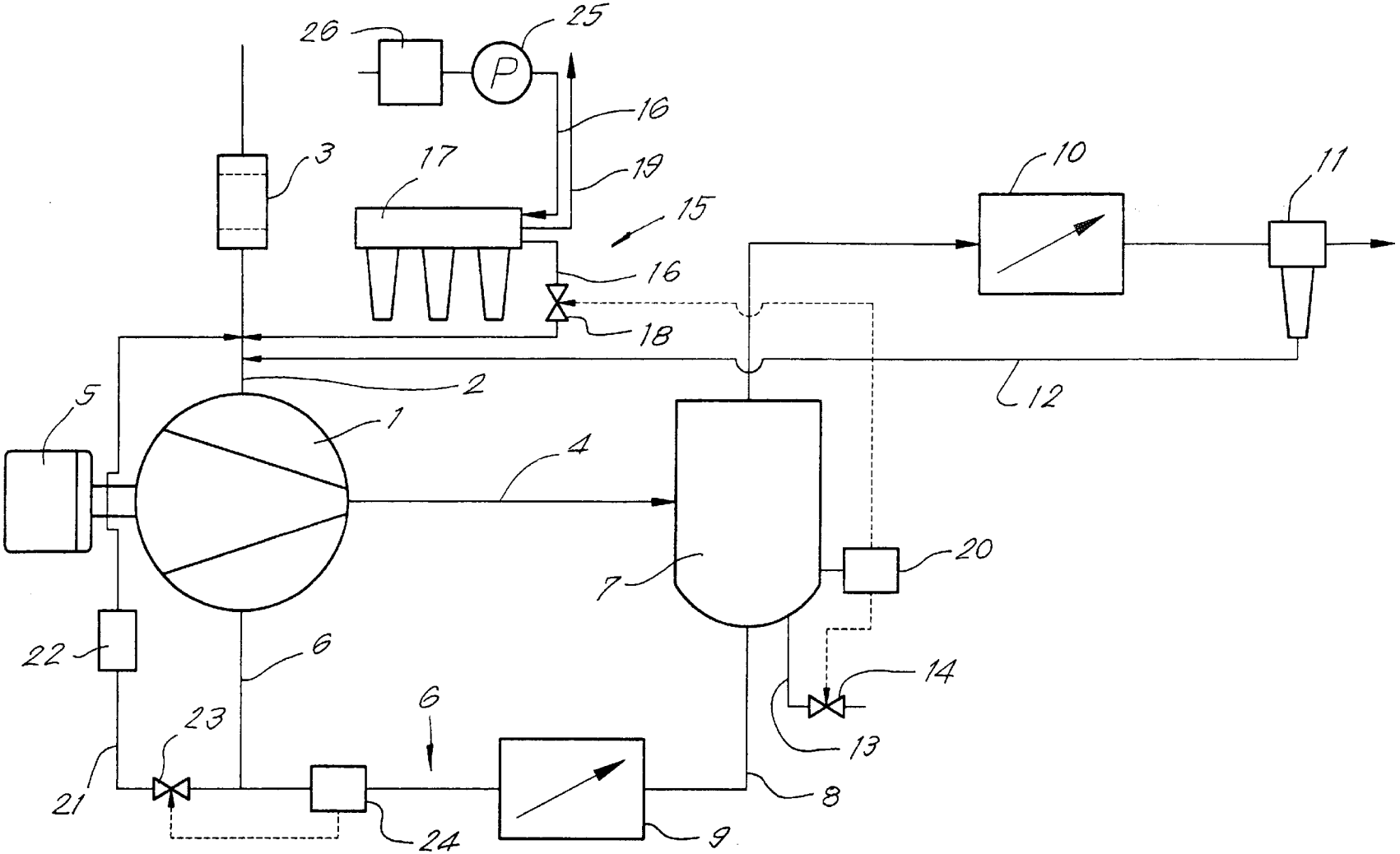
11
10
12
20
14
13
8
9
15
16
19
18
25
P
26
17
4
7
2
1
6
24
3
6
23
5
22
21

COMPRESSOR INSTALLATION WITH WATER-INJECTED COMPRESSOR ELEMENT

BACKGROUND OF THE INVENTION

1. Field of the Invention

The present invention concerns a compressor installation with at least one water-injected volumetric compressor element, provided with a suction line and a compressed air line, driving means for this compressor element, a water cycle in which the compressor element is erected, containing a water separator erected in the compressed air line and a return line for the separated water extending between the bottom side of said water separator and the inner space of the compressor element, and a water supply device for supplying water to the water cycle containing a water supply line with a controllable valve therein and a reverse osmosis filter, a device for measuring the amount of water in said water cycle and a device for measuring the conductivity of the water in this water cycle.

2. Discussion of the Related Art

With such compressor installations, water is injected on the compressing parts of the compressor element, to cool these parts as well as to lubricate them, and to fill the gaps between the mutual compressing parts as well as the gaps between the compressing parts and the housing of the compressor element.

Each compressor element can, depending on the temperature and the humidity of the sucked-in air, consume water or produce water, which is why a water supply device is provided with which, if necessary, water is supplied to the water cycle, usually via the inlet line of the compressor element.

The supplied water must be pure, and the mineral content must be sufficiently low in order to avoid deposits on seals, valves and the like. However, the mineral content should not be too low either, since the water can become corrosive then, for example as carbonic acid from the air can no longer be absorbed in the water and will be present in the water as free carbonic acid, as a result of which the pH will drop.

The corrosive character of the water can be determined on the basis of its conductivity. In order not to be corrosive, the conductivity of the water should be between 10 and 20 $\mu$S/cm at 25° C.

Distilled water is expensive. That is why the supplied water is usually treated on site, i.e. it is demineralized in a demineralization device.

A compressor installation with such a demineralization device is described in WO-A-99/02863.

This compressor installation has a single demineralization device which can be a reverse osmosis filter as well as an ion exchanger.

The demineralization device is connected to the rest of the compressor installation via lines with valves, in such a manner that the same device can be placed in the water supply line as well as in a by-pass bridging the water cycle.

The quality of the incoming water has little influence on the life of a reverse osmosis filter, but it does influence its yield. When the quality is bad, the output of the useful permeate will drop, and the output of the concentrate, which is to be removed, will rise.

A reverse osmosis filter is not particularly fit to reduce the conductivity of the water in the water cycle. A major part of the water cycle has to be discharged as a concentrate and hence has to be replaced by fresh water which has not been treated yet, with a relatively high conductivity, whose conductivity has to be reduced in the reverse osmosis filter.

Replacing a reverse osmosis filter as a demineralization device by an ion exchanger is not much better.

An ion exchanger is very well fit to reduce the conductivity of the water cycle, since it is relatively low already, but its life can be strongly reduced when fresh water of bad quality, and thus with a high conductivity, has to be treated.

SUMMARY OF THE INVENTION

The invention aims a compressor installation which does not have the above-mentioned and other disadvantages.

This aim is reached according to the invention in that a by-pass is connected to the water cycle in which are erected an ion exchanger and a controllable valve, whereby the valve in the water supply line is controlled by the device for measuring the amount of water in the water cycle, and the valve in the by-pass is controlled by the device for measuring the conductivity of the water.

The compressor installation thus has a separate demineralization device for the fresh water which is supplied to the water cycle and for reducing the conductivity of the water in the water cycle, so that both demineralization devices can function optimally and have a long life.

The by-pass can bridge the compressor element and thus extend between the return line and the suction line.

The device for measuring the conductivity is preferably provided in the return line.

The water supply device can be connected to the suction line.

The device for measuring the amount of water in the water cycle can be a hypsometer provided in or on the water separator.

BRIEF DESCRIPTION OF THE DRAWINGS

In order to better explain the characteristics of the invention, the following preferred embodiment of a compressor installation according to the invention is described as an example only without being limitative in any way, with reference to the accompanying drawing, which schematically represents a compressor installation according to the invention.

The compressor installation represented in FIG. 1 contains a water-injected volumetric compressor element 1, for example a screw-type compressor element, which is provided with a suction line 2 containing an air filter 3, and a compressed air line 4, driving means consisting of a motor 5 for this compressor element 1, and a water cycle 6 in which the compressor element 1 is erected and which further consists of a water separator 7 erected in the compressed air line 4, which in the given example forms an air receiver, the part of the compressed air line 4 situated between the compressor element 1 and said water separator 7, and a return line 8 for the separated water which extends between the bottom side of the water separator 7 and the water injection openings opening into the inner space of the compressor element 1.

In the return line 8 is erected a water cooler 9.

Downstream to the water separator 7 are successively erected an after-cooler 10 and a second smaller water separator 11 in the compressed air line 4.

A second return line 12 extends between the bottom side of this water separator 11 and the suction line 2.

Depending on the atmospheric conditions of the air which is sucked-in via the suction line 2, the compressor element 1 can consume water or produce it.

Onto the water cycle 6 is connected a discharge line 13 to this end, connected to the bottom side of the water separator 7, and provided with a controllable valve 14.

Of course, it is possible for the discharge line to be provided in another place in the water cycle 6, for example between the water cooler 9 and the compressor element 1.

In order to supply water to the water cycle 6, the compressor installation comprises a water supply device 15 containing a water supply line 16 which is not directly connected to the water cycle 6 but to the suction line 2.

In this water supply line 16 are provided a reverse osmosis filter 17 and a two-way valve 18.

The concentrate flows away from this reverse osmosis filter 17 via the concentrate line 19. The permeate flows towards the suction line 2.

The water supply device 15 contains a measuring device 20 to measure the amount of water which is present in the water cycle 6 and which controls the valves 14 and 18.

This amount of water can be determined by measuring the amount of water which is present in the first water separator 7, which can be determined by measuring the water level.

The term 'measuring' is understood in the broadest sense here, since not the exact amount of water needs to be known; by 'measuring' can also be understood determining when the level drops below a certain minimum value.

The measuring device 20 can possibly also determine when said level rises above a certain higher level to control the valve 14 as a function thereof.

In the given example, the measuring device 20 is thus formed of at least one or several level detectors.

The compressor element 1 is bridged by a by-pass 21 which is connected to the return line 8 between the compressor element 1 and the water cooler 9 on the one hand, and which is connected to the suction line 2 on the other hand.

In this by-pass 21 are erected an ion exchanger 22 and a controllable valve 23.

This valve 23 is controlled by a device 24 for measuring the conductivity of the water, erected in the return line 8.

When the device 20 for measuring the amount of water in the water cycle 6 detects that there is too little water, or in other words when it detects that the level in the water separator 7 has dropped under a minimum level, it will order the valve 18 to open until a sufficient amount of water has been supplied to the water cycle 6 via the water supply line 16.

This supplied water has been purified in the reverse osmosis filter 17.

When the device 24 for measuring the conductivity measures a readout which is too high, it will order the valve 23 to open, as a result of which water flows from the return line 8 via the by-pass 21 and thus over the ion exchanger 22 to the suction line 2.

No water from the water cycle is lost hereby.

As the conductivity of the water from the water cycle is already relatively low and in any case lower than the conductivity of the fresh mains water, the ion exchanger 22 will only have to further reduce the conductivity of the water from the water cycle treated by it to a limited extent, which implies that the ion exchanger has a relatively long life and does not have to be replaced often.

Since, in order not to restrict the life of the ion exchanger 22, the reverse osmosis filter 17 takes care of the purification of the supplied water, the latter will have to function optimally under all circumstances.

Thus, according to a variant, the water supply device 15 may contain a pump 25 which is provided upstream to the reverse osmosis filter 17 in the water supply line 16 to put the water under extra pressure. The osmotic pressure to be overcome depends on the concentration of dissolved salts in the water.

The extra pressure will ensure a good service of the membrane when the water supply line 16 is connected to the public water supply system and the water supply pressure is insufficient.

According to another variant, a decalcifier 26 is erected in the water supply line 16, upstream to the reverse osmosis filter 17.

If the feed water has a high conductivity, it will be due for more than 80% to the presence of calcium salts and magnesium salts.

They can be removed by means of the decalcifier 26, which significantly improves the service of the osmosis membrane of the reverse osmosis filter 17.

As is represented in the figure, this decalcifier 26 can be erected in the water supply line 16 together with the pump 25, in particular upstream to the latter.

The volumetric compressor element 1 does not necessarily have to be a screw-type compressor element. It may just as well be a tooth compressor element, a spiral compressor element or a mono screw-type compressor element.

The invention is by no means limited to the above-described embodiment represented in the accompanying drawings; on the contrary, such a compressor installation can be made in all sorts of variants while still remaining within the scope of the invention, as specified in the following claims.

What is claimed is:

1. A compressor installation with at least one water-injected volumetric compressor element, provided with a suction line and a compressed air line;

driving means for this compressor element;

a water cycle in which the compressor element is erected, containing a water separator erected in the compressed air line and a return line for the separated water, extending between the bottom side of said water separator and the inner space of the compressor element;

a water supply device for supplying water to the water cycle containing a water supply line with a controllable valve therein and a reverse osmosis filter;

a device for measuring the amount of water in said water cycle;

a device for measuring the conductivity of the water in this water cycle, a by-pass connected to the water cycle in which are erected an ion exchanger and a controllable valve;

whereby the valve in the water supply line is controlled by the device for measuring the amount of water in the water cycle, and the valve in the by-pass is controlled by the device for measuring the conductivity of the water.

2. The compressor installation of claim 1, wherein the by-pass bridges the compressor element and thus extents between the return line and the suction line.

3. The compressor installation of claim 1, wherein the device for measuring the conductivity is provided in the return line.

4. The compressor installation of claim 1, wherein the water supply device is connected to the suction line.

5. The compressor installation of claim 1, wherein the device for measuring the amount of water in the water cycle is a hypsometer provided in or on the water separator.

6. The compressor installation claim 1, wherein the water supply device contains a pump which is erected in the water supply line, upstream to the reverse osmosis filter.

7. The compressor installation of claim 1, wherein the water supply device contains a decalcifier which is erected in the water supply line, upstream to the reverse osmosis filter.

8. The compressor installation of claim 1, wherein a discharge line is connected to the water cycle, provided with a valve which is controlled by the device for measuring the amount of water in the water cycle.

9. The compressor installation of claim 8, wherein the discharge line is connected to the water separator.

* * * * *